US006935328B2

(12) United States Patent
Haynes et al.

(10) Patent No.: US 6,935,328 B2
(45) Date of Patent: Aug. 30, 2005

(54) METHOD AND APPARATUSES FOR GAS RANGES

(75) Inventors: Joel Meier Haynes, Niskayuna, NY (US); David Joseph Najewicz, Prospect, KY (US); Derrick Douglas Little, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/460,888

(22) Filed: Jun. 13, 2003

(65) Prior Publication Data

US 2004/0250808 A1 Dec. 16, 2004

(51) Int. Cl.[7] ..... F24C 3/12
(52) U.S. Cl. ..... 126/41 R
(58) Field of Search ..... 126/39 R, 41 R, 126/39 E, 39 J, 39 K, 39 BA; 431/258–264, 266; 219/267–270, 260, 261; 216/260

(56) References Cited

U.S. PATENT DOCUMENTS 3,823,345 A 7/1974 Mitts et al.
4,029,936 A * 6/1977 Schweitzer ..... 219/267
4,188,937 A 2/1980 Baynes
4,357,526 A * 11/1982 Yamamoto et al. ..... 219/544
4,905,660 A 3/1990 Leduc
5,002,038 A * 3/1991 Riehl ..... 126/39 R
5,264,681 A * 11/1993 Nozaki et al. ..... 219/544
5,492,469 A 2/1996 Oda et al.
5,556,272 A * 9/1996 Blasko et al. ..... 431/75
5,856,651 A * 1/1999 Shaffer ..... 219/270
5,892,201 A * 4/1999 Croucher et al. ..... 219/267
5,899,681 A 5/1999 Maughan
5,960,783 A * 10/1999 Schubert et al. ..... 126/41 R
6,002,107 A * 12/1999 Willkens et al. ..... 219/270
6,012,443 A * 1/2000 Peug ..... 126/39 E
6,089,219 A * 7/2000 Kodera et al. ..... 126/39 R
6,173,708 B1 1/2001 Arntz et al.
6,664,514 B1 * 12/2003 Marshall ..... 219/267

* cited by examiner

*Primary Examiner*—Stephen Gravini
(74) *Attorney, Agent, or Firm*—George L. Rideout, Jr.; Armstrong Teasdale LLP

(57) ABSTRACT

A gas burner assembly for connection to a source of gas includes a burner body, a burner cap disposed over the burner body, a ceramic igniter positioned adjacent the burner body, and a ceramic igniter protection apparatus positioned adjacent to the ceramic igniter, the ceramic igniter protection apparatus is configured to shield the ceramic igniter from inadvertent contact.

23 Claims, 23 Drawing Sheets

METHOD AND APPARATUSES FOR GAS RANGES

BACKGROUND OF THE INVENTION

This invention relates generally to a method an apparatus for igniting a burner flame, and, more particularly, to method and apparatuses for protecting an igniter used to ignite a flame of a gas burner.

Some gas-fired cooktops include an ignition device to generate a spark to ignite a burner when applicable fuel valves are opened to deliver fuel to the burner. Other gas-fired cooktops utilize a ceramic hot surface igniter to ignite the burner. Rather than relying on a spark, a ceramic hot surface igniter includes an element that generates sufficient heat to ignite the gas supplied to the burner. A ceramic hot surface igniter used in a cooking system may be more susceptible to breakage and contamination than a conventional spark igniter. Additionally, the ceramic igniter is often subjected to impacts from an operator during routine cleaning and maintenance which may cause the ceramic igniter to break.

BRIEF DESCRIPTION OF THE INVENTION

In one aspect, a gas burner assembly for connection to a source of gas is provided. The burner assembly includes a burner body, a burner cap disposed over the burner body, a ceramic igniter positioned adjacent the burner body, and a ceramic igniter protection apparatus positioned adjacent to the ceramic igniter, the ceramic igniter protection apparatus is configured to shield the ceramic igniter from inadvertent contact.

In another aspect, a gas range is provided. The gas range includes a cooktop, and a gas burner assembly for connection to a source of gas positioned in the cooktop. The gas burner assembly includes a burner body, a burner cap disposed over the burner body, a ceramic igniter positioned adjacent the burner body, and a ceramic igniter protection apparatus positioned adjacent to the ceramic igniter, the ceramic igniter protection apparatus configured to shield the ceramic igniter from inadvertent contact.

In a further aspect, a method for protecting a ceramic igniter is provided. The method includes providing a gas burner assembly for connection to a source of gas. The gas burner assembly includes a cooktop, a burner body positioned in the cooktop, a burner cap disposed over the burner body, and a ceramic igniter positioned adjacent said burner body. The method also includes positioning a ceramic igniter protection apparatus adjacent to the ceramic igniter such that the ceramic igniter protection apparatus is configured to shield the ceramic igniter from inadvertent contact.

DETAILED DESCRIPTION OF THE INVENTION

While the methods and apparatuses are herein described in the context of a gas-fired cooktop, as set forth more fully below, it is contemplated that the herein described methods and apparatuses may find utility in other applications, including but not limited to, gas heater devices, gas ovens, gas kilns, gas-fired meat smoker devices, and gas barbecues. In addition, the principles and teaching set forth herein may find equal applicability to combustion burners for a variety of combustible fuels. The description hereinbelow is therefore set forth only by way of illustration rather than limitation, and any intention to limit practice of the herein described methods and apparatuses to any particular application is expressly disavowed.

Figure 1:
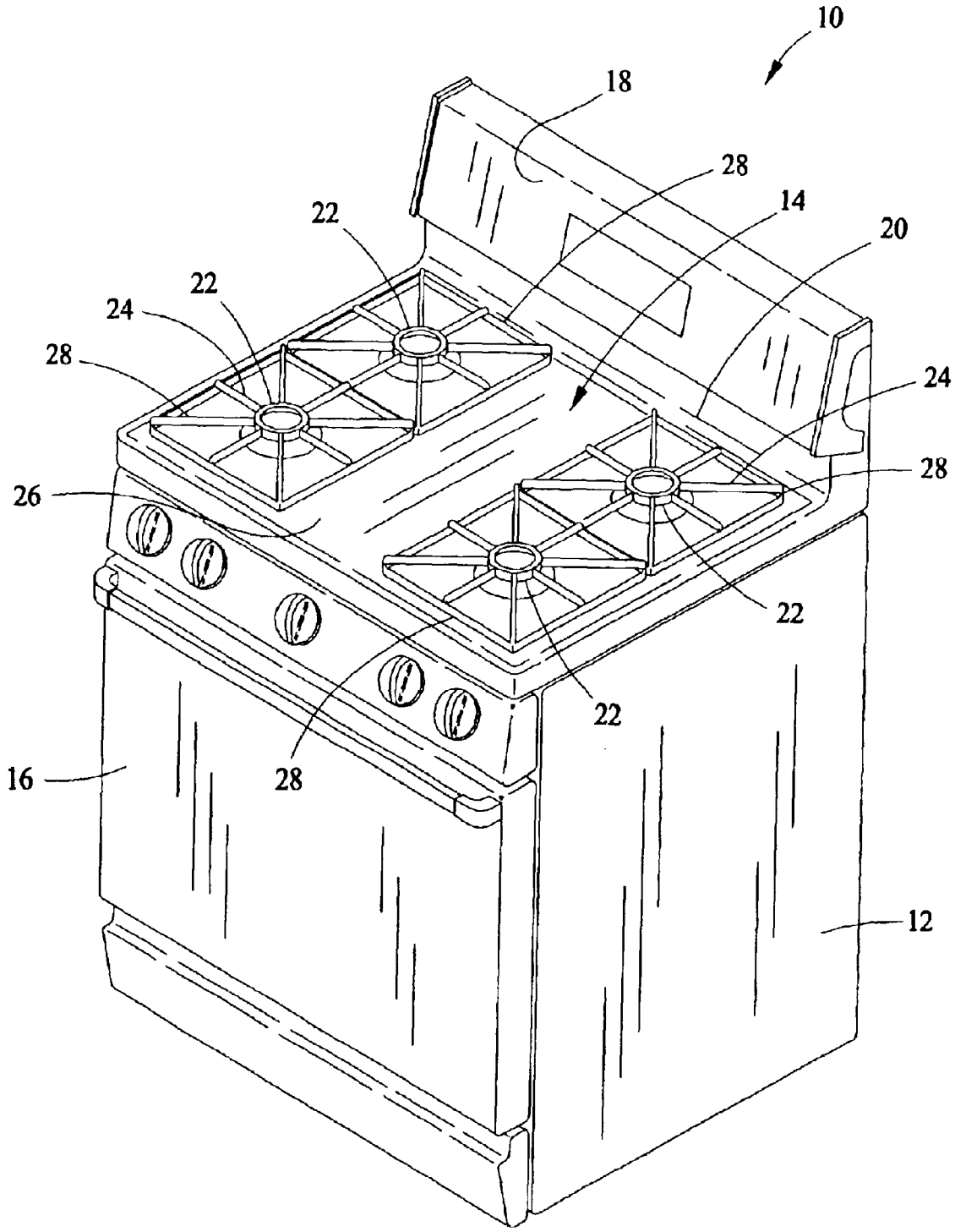
FIG. 1 is perspective view of an oven range.

FIG. 1 illustrates an exemplary free standing gas range 10 in which the herein described methods and apparatuses may be practiced. Range 10 includes an outer body or cabinet 12 that incorporates a generally rectangular cooktop 14. An oven, not shown, is positioned below cooktop 14 and has a front-opening access door 16. A range backsplash 18 extends upward of a rear edge 20 of cooktop 14 and contains various control selectors (not shown) for selecting operative features of heating elements for cooktop 14 and the oven. It is contemplated that the herein described methods and apparatuses is applicable, not only to cooktops which form the upper portion of a range, such as range 10, but to other forms of cooktops as well, such as, but not limited to, free standing cooktops that are mounted to a kitchen counter. Therefore, gas range 10 is provided by way of illustration rather than limitation, and accordingly there is no intention to limit application of the herein described methods and apparatuses to any particular appliance or cooktop, such as range 10 or cooktop 14.

Cooktop 14 includes four gas fueled burner assemblies 22 which are positioned in spaced apart pairs positioned adjacent each side of cooktop 14. Each pair of burner assemblies 22 is surrounded by a recessed area 24 of cooktop 14. Recessed areas 24 are positioned below an upper surface 24 of cooktop 14 and serve to catch any spills from cooking utensils (not shown in FIG. 1) being used with cooktop 14. Each burner assembly 22 extends upwardly through an opening in recessed areas 24, and a grate 28 is positioned over each burner 22. Each grate 28 includes a flat surface thereon for supporting cooking vessels and utensils over burner assemblies 22 for cooking of meal preparations placed therein.

The construction and operation of the range heating elements, including cooktop gas burner assemblies 22 are believed to be within the purview of those in the art without further discussion, and as details of the range heating elements are generally beyond the scope of the herein described methods and apparatuses, further description thereof is omitted. Further, it is contemplated that the herein described methods and apparatuses may find utility in combination with other heat sources besides range gas burners 22.

While cooktop 14 includes two pairs of grates 28 positioned over two pairs of burner assemblies 22 it is contemplated that greater or fewer numbers of grates could be employed with a greater or fewer number of burners without departing from the scope of the herein described methods and apparatuses.

Figure 2:
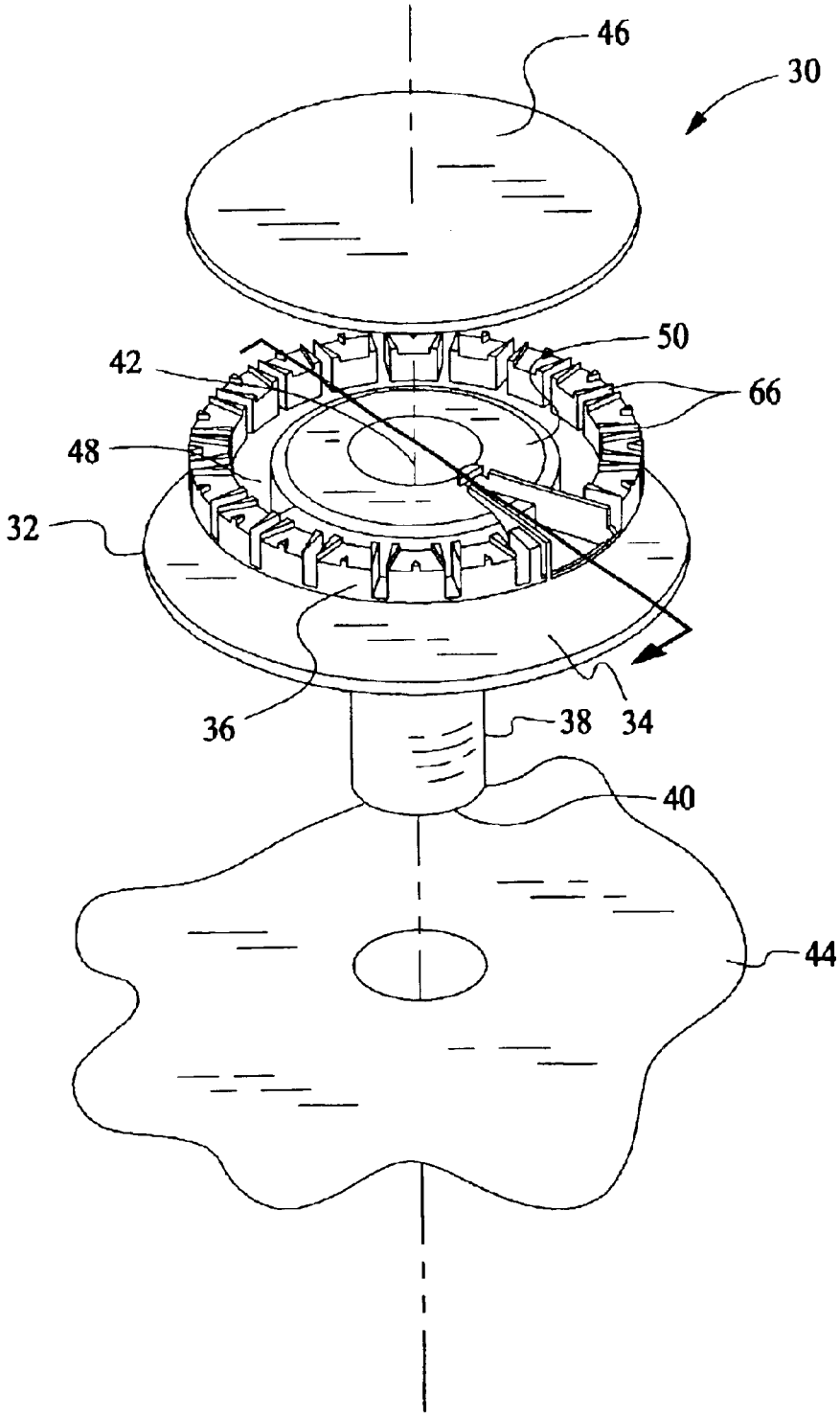
FIG. 2 is an exploded perspective view of a burner assembly.
Figure 3:
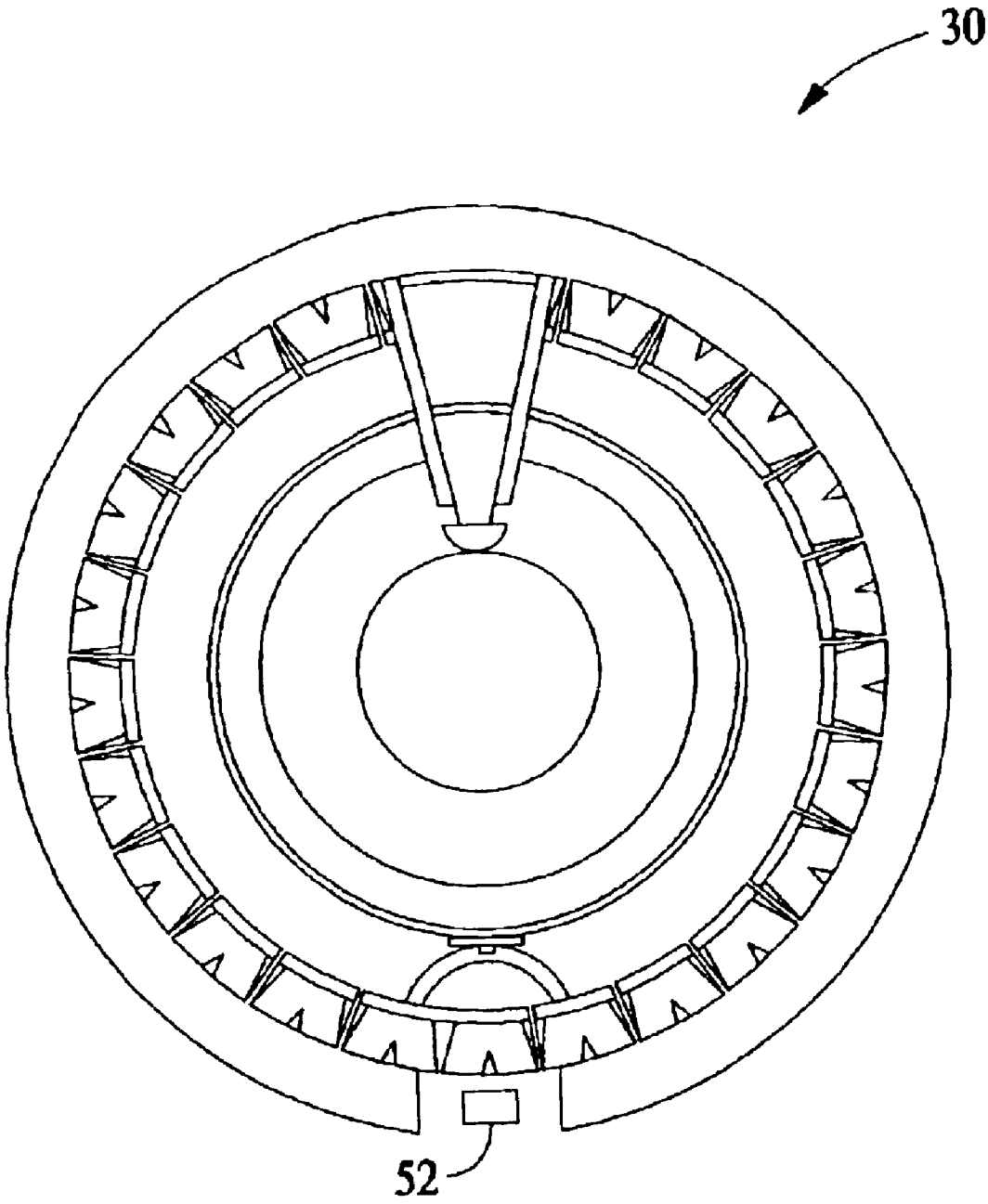
FIG. 3 is a top plan view of the burner assembly shown in FIG. 2.

FIG. 2 is an exploded perspective view of an exemplary burner assembly 30 that can be used with gas range 10 (shown in FIG. 1). FIG. 3 is a top plan view of burner assembly 30 shown in FIG. 2. Burner assembly 30 includes a burner body 32, a solid base portion 34, and a cylindrical sidewall 36 extending axially from the periphery of base portion 34. A main gas conduit 38 having an entry area 40 and a burner throat region 42 is open to the exterior of burner body 32 and defines a passage which extends axially through the center of burner body 32 to provide fuel/air flow to burner assembly 30. As used herein, the term "gas" refers to a combustible gas or gaseous fuel-air mixture.

Burner assembly 30 is mounted on a support surface 44, such as cooktop 14, of a gas cooking appliance such as a range or a cooktop. A cap 46 is disposed over the top of burner body 32, defining therebetween an annular main fuel chamber 48 and annular diffuser region (not shown). A toroidal-shaped upper portion 50 of burner body 32, immediately bordering burner throat 42, in combination with cap 46 defines the annular diffuser region therebetween. Cap 46 can be fixedly attached to sidewall 36 or other designated attachment point or can simply rest on sidewall 36 for easy removal. Burner assembly 30 also includes at least one igniter 52 extending through an opening in base portion 34. In the exemplary embodiment, igniter 52 is fabricated from a ceramic material. While one type of burner is described and illustrated, the herein described methods and apparatuses are applicable to other types of burners, such as stamped aluminum burners and separately mounted orifice burners.

Figure 4:
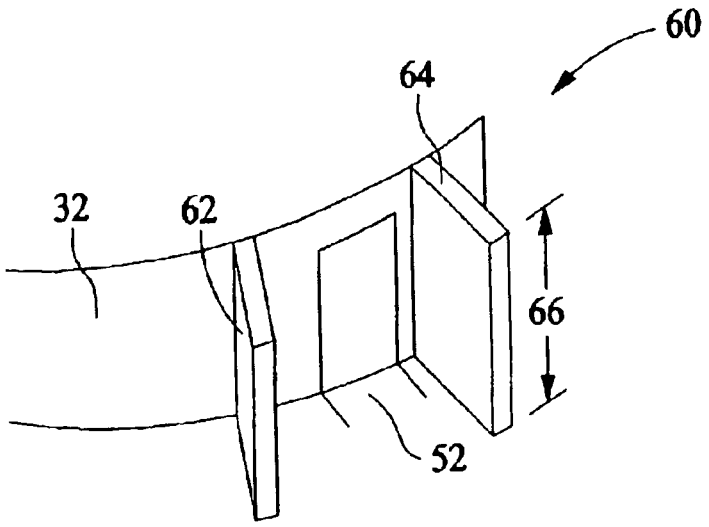
FIG. 4 is a perspective view of an igniter protection apparatus that can be used with the burner assembly shown in FIG. 2.
Figure 5:
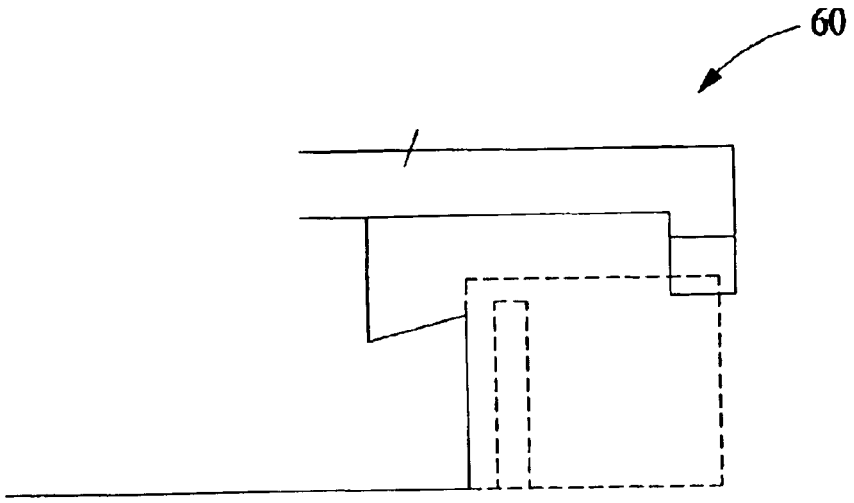
FIG. 5 is a side view of the protection apparatus shown in FIG. 4.
Figure 6:
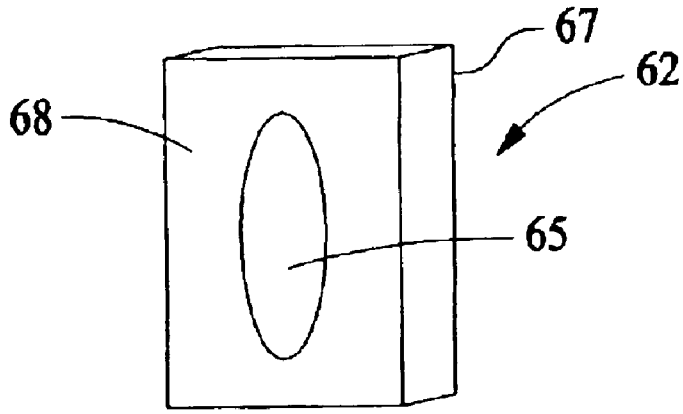
FIG. 6 is a perspective view of a portion of the protection apparatus shown in FIG. 4.
Figure 7:
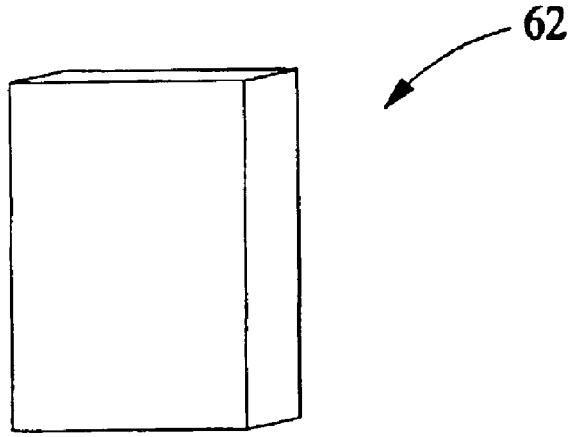
FIG. 7 is another embodiment of a portion of the protection apparatus shown in FIG. 4.
Figure 8:
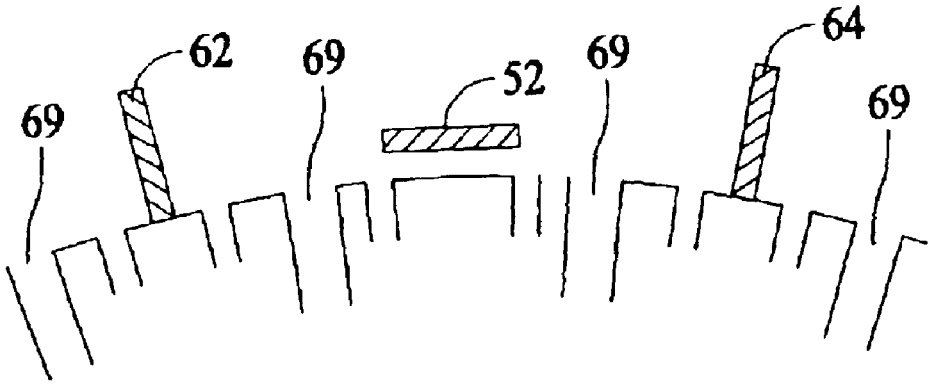
FIG. 8 is a top view of the protection apparatus shown in FIG. 4.

FIG. 4 is a perspective view of an igniter protection apparatus 60 that can be used with burner assembly 30 (shown in FIG. 2). FIG. 5 is a side view of protection apparatus 60 shown in FIG. 4. FIG. 6 is another embodiment of a portion of protection apparatus 60 shown in FIG. 4. FIG. 7 is a perspective view of a portion of protection apparatus 60 shown in FIG. 4. FIG. 8 is a top view of protection apparatus 60. Apparatus 60 includes a first fin 62 and a second fin 64 extending from a surface of burner body 32. First fin 62 and second fin 64 include a first height 66 which is greater than a height of igniter 52. In one embodiment, first fin 62 and second fin 64 are substantially solid. In another embodiment, first fin 62 and second fin 64 each include an opening 65 extending between a first side 67 and a second side 68 of first fin 62 and second fin 64 respectively.

In use, igniter 52 is positioned between first fin 62 and second fin 64 such that igniter 52 is substantially protected from damage that can occur when igniter 52 is inadvertently struck by an operator. For example, since a height of the first fin 62 and the second fin 64 is greater than a height of igniter 52, igniter 52 is recessed beneath fin 62 and fin 64, thereby substantially decreasing any inadvertent damage to igniter 52. Additionally, by positioning fin 62 and fin 64 at a center point approximately midway between adjacent burner ports 69, the temperature of the surrounding area can be substantially reduced thereby facilitating protecting fins 62 and 64 or burner body 32 from excessive heat while ensuring there is no blockage of the burner ports. In one embodiment, first fin 62 and second fin 64 are fabricated from the same material as burner body 32, such as, but not limited to aluminum, tin, stainless steel, high temperature steels, and brass.

Figure 9:
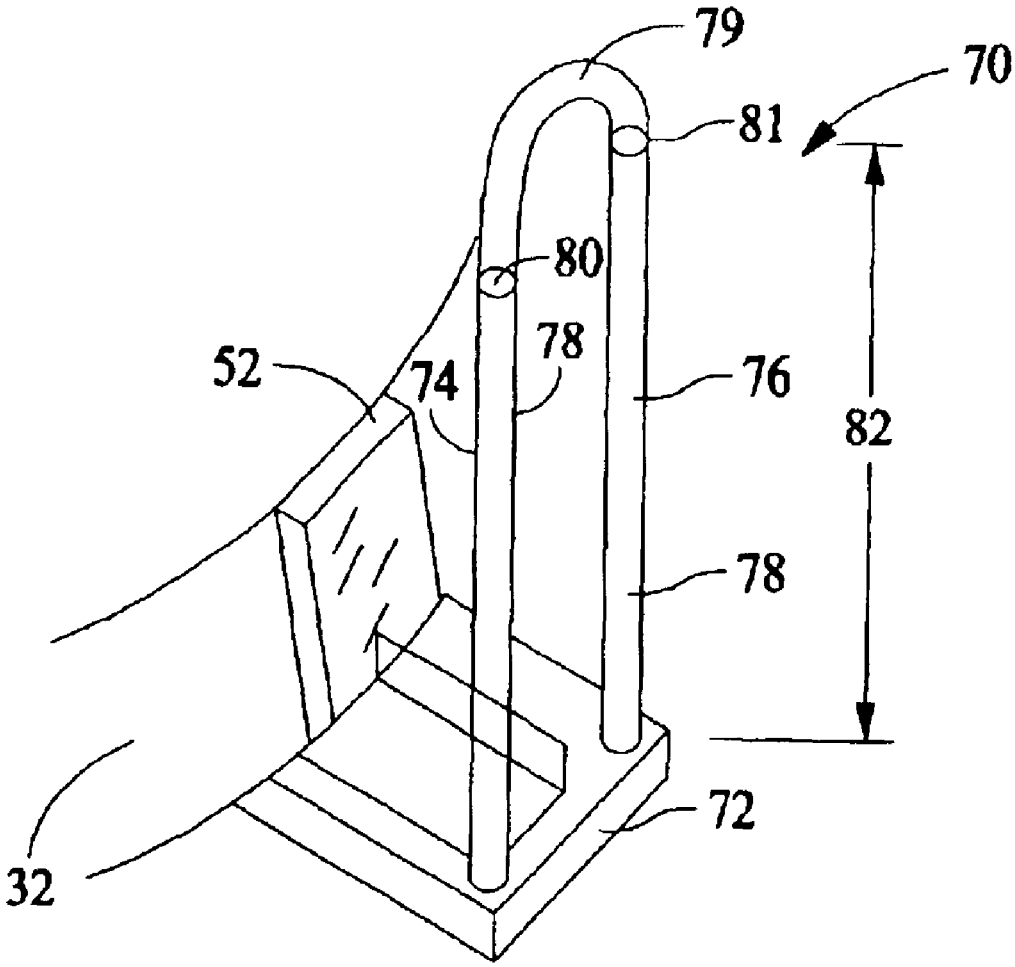
FIG. 9 is a perspective view of an igniter protection apparatus that can be used with the burner assembly shown in FIG. 2.
Figure 10:
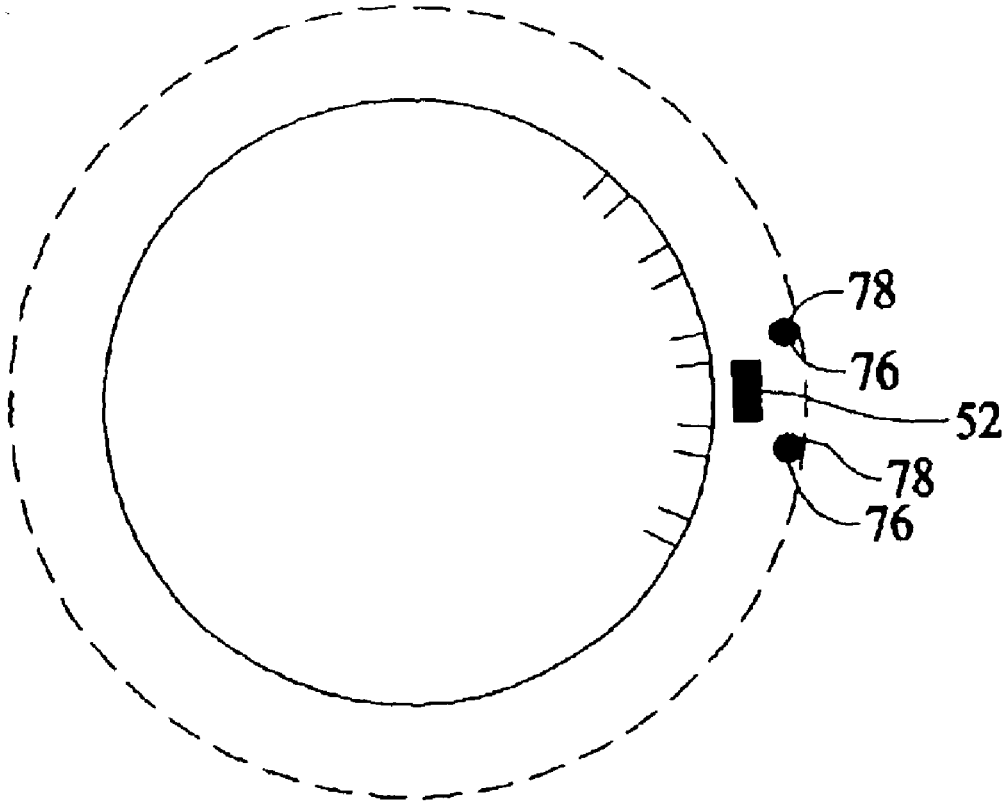
FIG. 10 is a top view of the protection apparatus shown in FIG. 9.
Figure 11:
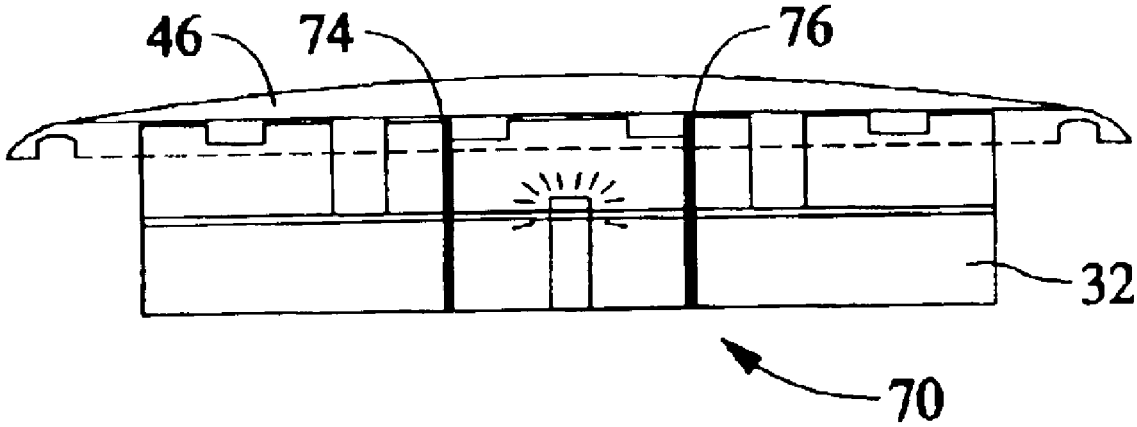
FIG. 11 is a side view of the protection apparatus shown in FIG. 9.
Figure 12:
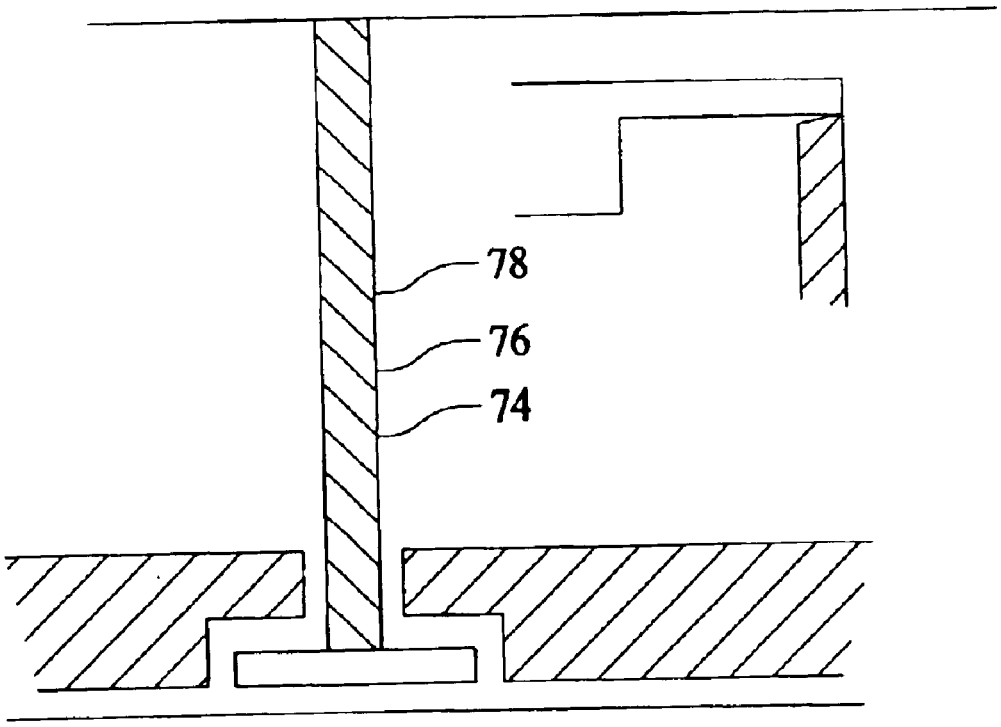
FIG. 12 is another side view of the protection apparatus shown in FIG. 9.

FIG. 9 is an illustration of an igniter protection apparatus 70 that can be used with burner assembly 30 (shown in FIG. 2). FIG. 10 is a top view of protection apparatus 70 shown in FIG. 9. FIG. 11 is a side view of protection apparatus 70 shown in FIG. 9. FIG. 12 is a side view of a replaceable embodiment of the protection apparatus 70 shown in FIG. 9. Apparatus 70 includes a tab 72 mechanically coupled to burner body 32. In an exemplary embodiment, apparatus 70 includes a first removable post 74 and a second removable post 76 extending perpendicularly from tab 72. In another exemplary embodiment, apparatus 70 includes a plurality of posts 78 extending perpendicularly from tab 72. In one embodiment, apparatus 70 also includes a connector 79 extending from a first end 80 of first post 74 to a first end of second post 76. First post 74 and second post 76 include a first height 82 which is greater than a height of igniter 52. In one embodiment, first post 74 and second post 76 are substantially solid. First post 74 and second post 76 are fabricated from a material such as, but not limited to aluminum, stainless steel, high temperature steels, and brass.

In use, igniter 52 is positioned between first post 74 and second post 76 such that igniter 52 is substantially protected from damage that can occur when igniter 52 is inadvertently struck by an operator. For example, since a height of the first post 74 and second post 76 is greater than a height of igniter 52, the igniter is recessed beneath first post 74 and second post 76, thereby substantially decreasing any inadvertent damage to igniter 52. Apparatus 70 facilitates forming a shield around ceramic igniter 52 by using posts 74 and 76 to shield igniter 52 from impact. Additionally, an in another exemplary embodiment, protection apparatus 70 is configured to interface with the burner cap. For example, burner cap 46 (shown in FIG. 14) can include an opening, such as a slot, with protection apparatus 70 configured to extend at least partially through the opening. In one embodiment, protection apparatus 70 is free-standing, i.e. is not physically coupled to either the cooktop or the burner. In another embodiment, protection apparatus 70 is mechanically coupled to at least one of cooktop 14, burner body 32, or burner base 34.

Figure 13:
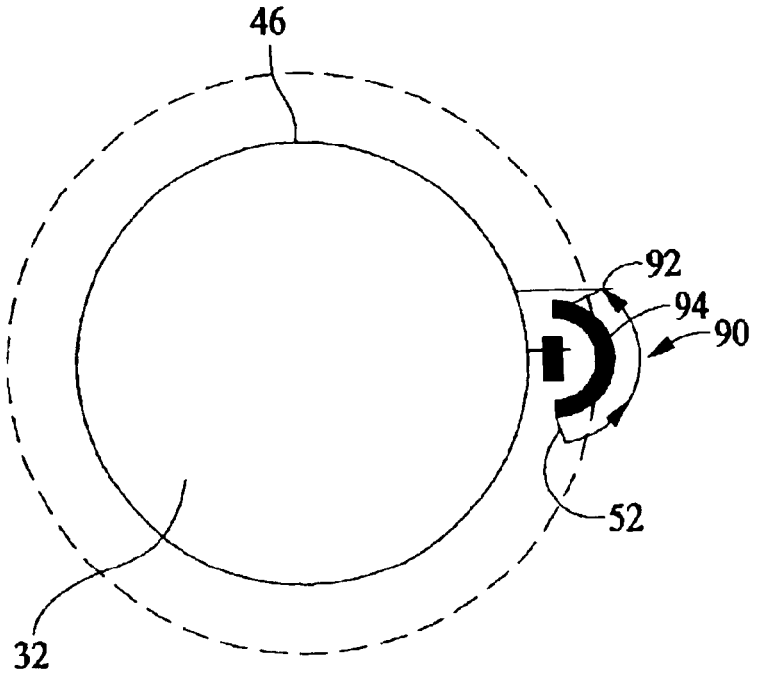
FIG. 13 is a top view of an igniter protection apparatus that can be used with the burner assembly shown in FIG. 2.
Figure 14:
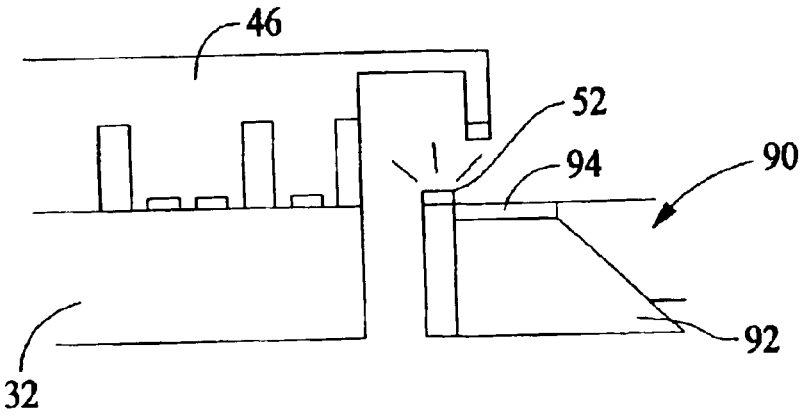
FIG. 14 is a side view of the igniter protection apparatus shown in FIG. 13.

FIG. 13 is a top view of an igniter protection apparatus 90 that can be used with burner assembly 30 (shown in FIG. 2). FIG. 14 is a side view of igniter protection apparatus 90 shown in FIG. 13. In an exemplary embodiment, apparatus 90 includes a first guard portion 92 mechanically coupled to burner body 32 and a second guard portion 94 mechanically coupled to first guard portion 92. In another embodiment, first guard portion 92 is mechanically coupled to cooktop 14. In one embodiment, first guard portion 92 includes a cross-section that is approximately trapezoidal shaped. In another embodiment, first guard portion 92 includes a cross-section that is shaped other than trapezoidal. First guard portion 92 is fabricated from a material such as, but not limited to aluminum, stainless steel, high temperature steels, and brass. Second guard portion 94 is fabricated from a material such as, but not limited to, aluminum, stainless steel, and brass. Apparatus 90 is configured to at least partially circumscribe igniter 52.

In use, igniter 52 is positioned adjacent to apparatus 90 and is substantially protected from damage that can occur when the igniter is inadvertently struck by an operator. For example, when an operator exerts a force toward igniter 52, the force is deflected into apparatus 90 thereby substantially decreasing any inadvertent damage to igniter 52. Apparatus 90 facilitates forming a shield around ceramic igniter 52 by using a horse-shoe shaped apparatus 90 at least partially circumscribing igniter 52.

Figure 15:
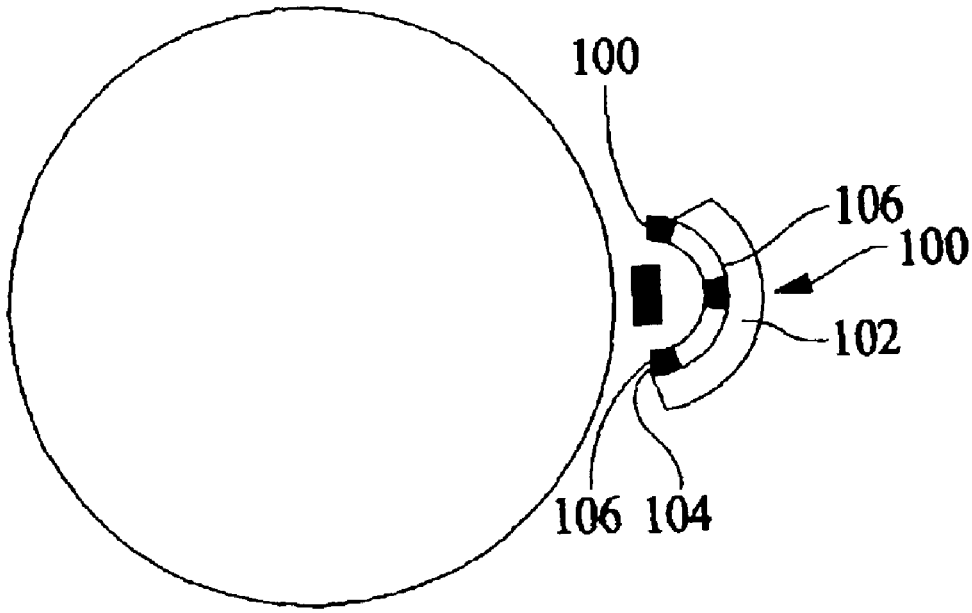
FIG. 15 is a top view of an igniter protection apparatus that can be used with the burner assembly shown in FIG. 2.
Figure 16:
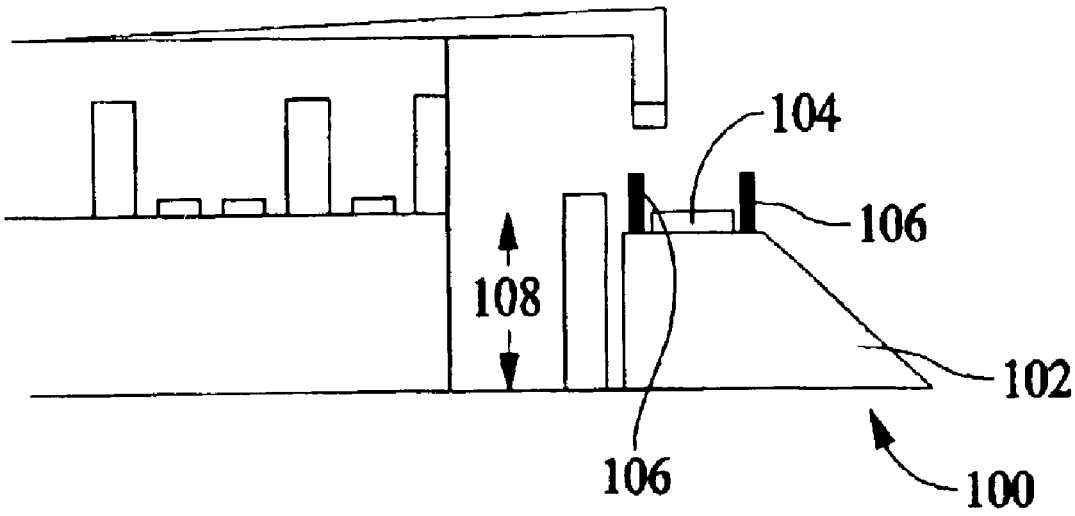
FIG. 16 is a side view of the igniter protection apparatus shown in FIG. 15.
Figure 17:
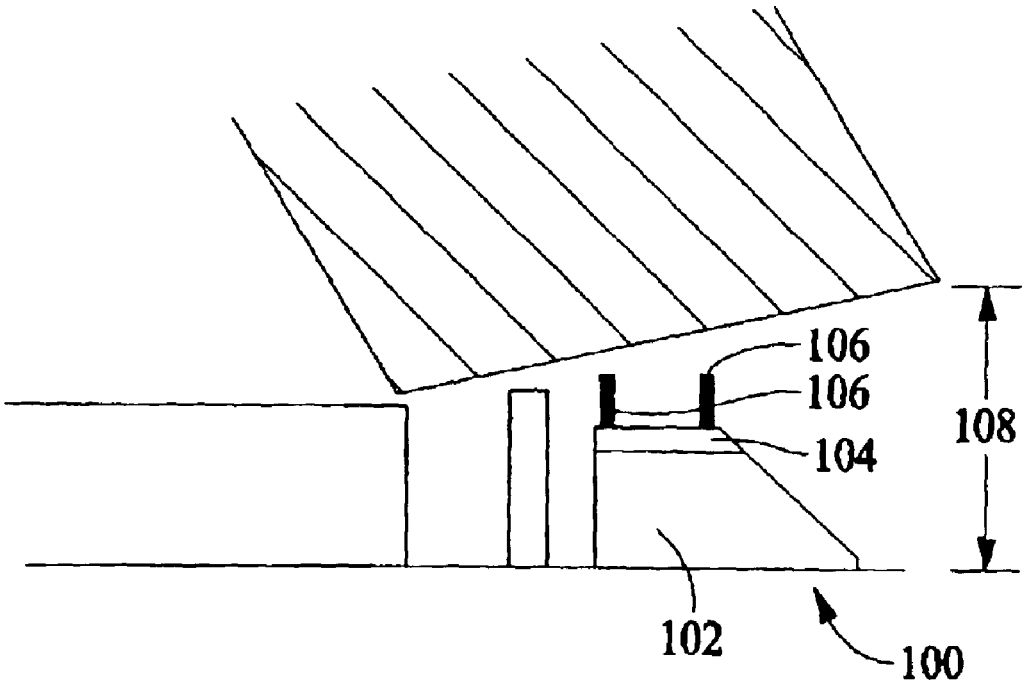
FIG. 17 is another side view of the igniter protection apparatus shown in FIG. 15.

FIG. 15 is a top view of an igniter protection apparatus 100 that can be used with burner assembly 30 (shown in FIG. 2). FIG. 16 is a side view of igniter protection apparatus 100 shown in FIG. 15. FIG. 17 is another side view of igniter protection apparatus 100 shown in FIG. 15. In an exemplary embodiment, apparatus 100 includes a first guard portion 102 mechanically coupled to burner body 32 and a second guard portion 104 mechanically coupled to first guard portion 102. In another embodiment, first guard portion 102 is mechanically coupled to cooktop 14. In one embodiment, first guard portion 102 includes a cross-section that is approximately trapezoidal shaped. In another embodiment, first guard portion 102 includes a cross-section that is shaped other than trapezoidal. Apparatus 100 also include at least two tabs 106 mechanically coupled to second guard portion 104. First guard portion 102, second guard portion 104, and tabs 106 include a combined height 108 which is greater than a height of igniter 52. First guard portion 102 is fabricated from a material such as, but not limited to aluminum, stainless steel, high temperature steels, and brass. Second guard portion 104 is fabricated from a material such as, but not limited to, aluminum, stainless steel, high temperature steels, and brass. Tabs 106 are fabricated from a material such as, but not limited to aluminum, stainless steel, high temperature steels, and brass.

In use, igniter 52 is positioned adjacent to apparatus 100 and is substantially protected from damage that can occur when the igniter is inadvertently struck by an operator. For example, when an object is inadvertently dropped toward igniter 52, tabs 106 facilitate deflecting the object away from igniter 52 thereby substantially decreasing any inadvertent damage to igniter 52. Apparatus 100 facilitates forming a shield around ceramic igniter 52 by using a horse-shoe shaped apparatus 100 at least partially circumscribing igniter 52.

Figure 18:
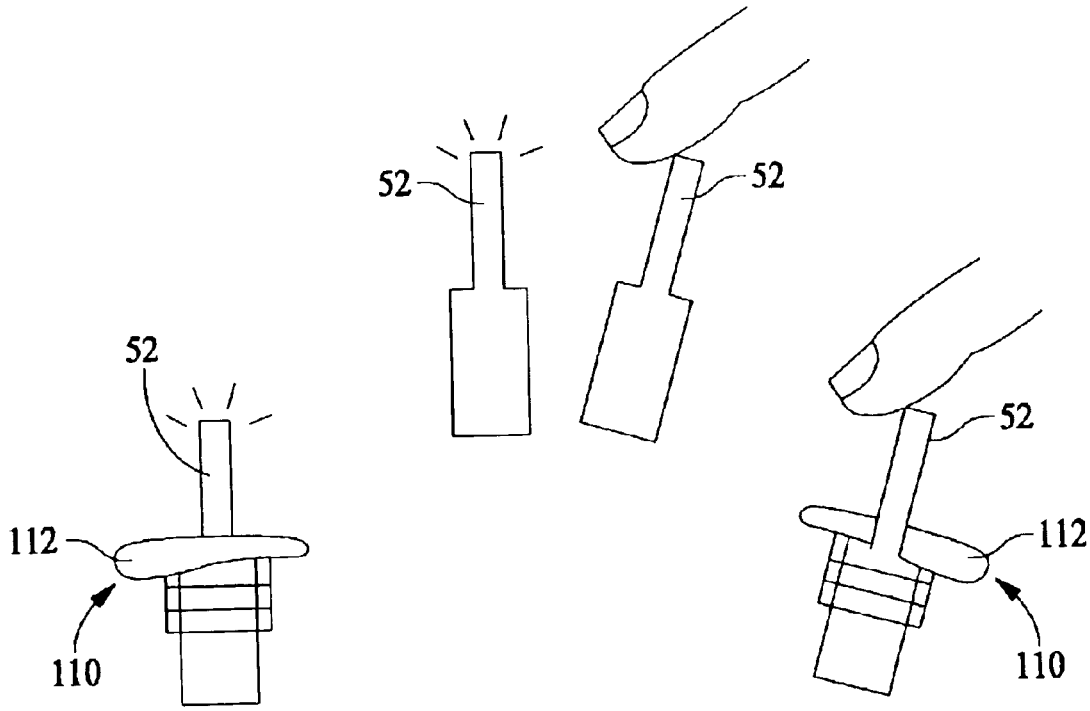
FIG. 18 is an illustration of an igniter protection apparatus that can be used with the burner assembly shown in FIG. 2.

FIG. 18 is an illustration of an igniter protection apparatus 110 that can be used with burner assembly 30 (shown in FIG. 2). In an exemplary embodiment, apparatus 110 includes a flexible device 112 positioned around igniter 52 and beneath cooktop 14. Flexible device 112 is fabricated from a material such as, but not limited to steel, tin, or brass.

In use, flexible apparatus 110 is positioned around igniter 52 such that when pressure is exerted on igniter 52, igniter 52 deflects but does not break, thereby substantially protecting igniter 52 from damage that can occur when the igniter is inadvertently struck by an operator. In the exemplary embodiment, flexible apparatus 110 can be used with any other igniter protection apparatus described herein.

Figure 19:
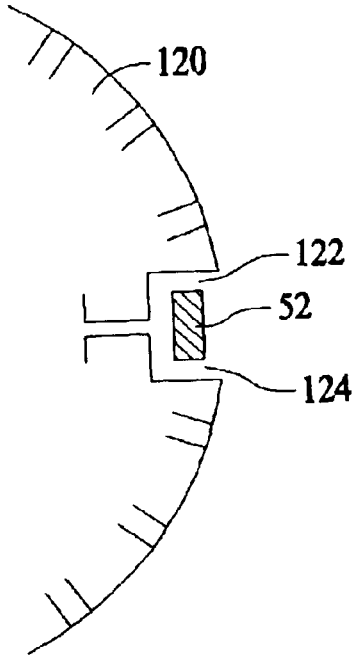
FIG. 19 is top view of a burner body that is a modification of the burner assembly shown in FIG. 2.
Figure 20:
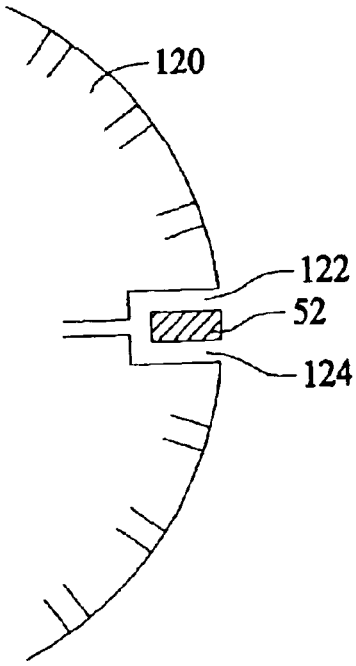
FIG. 20 is a top view of another embodiment of a burner body that is a modification of the burner assembly shown in FIG. 2.
Figure 21:
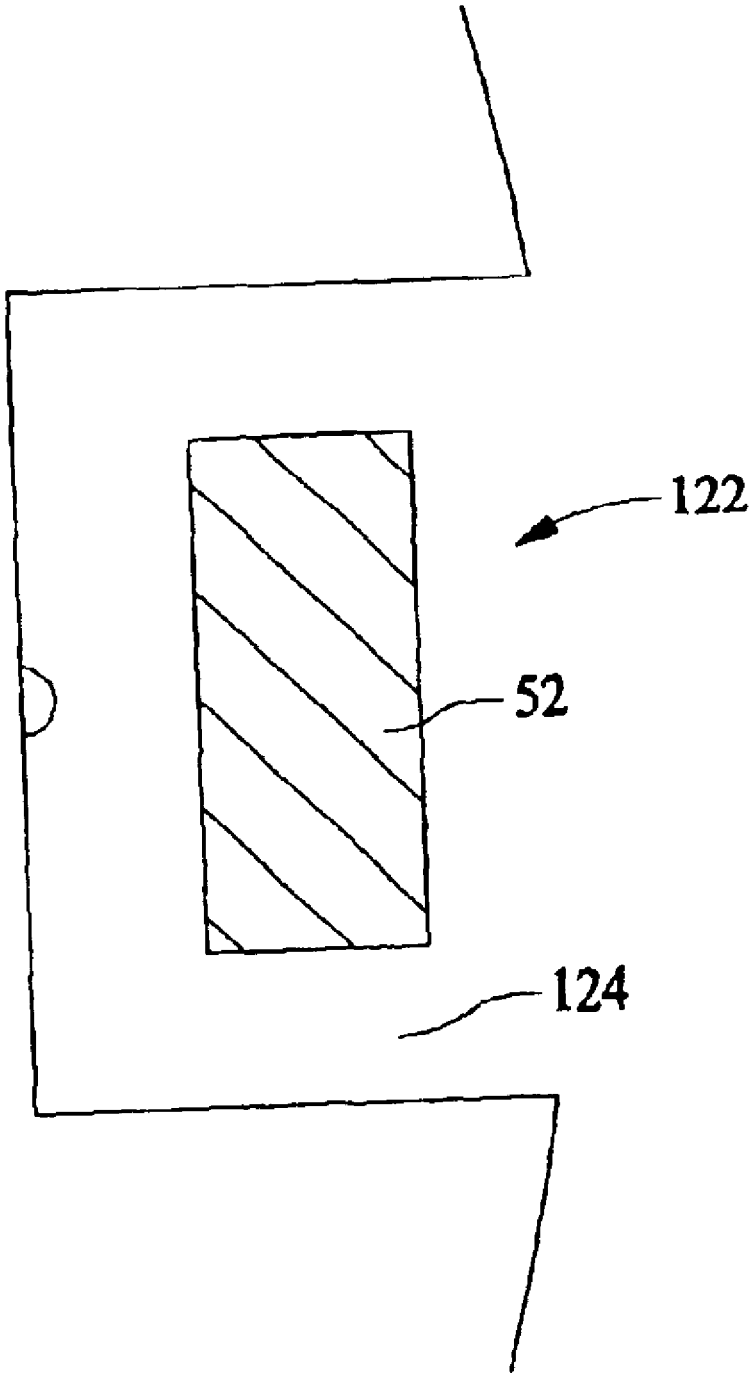
FIG. 21 is a top view of a portion of the burner body shown in FIG. 19.
Figure 22:
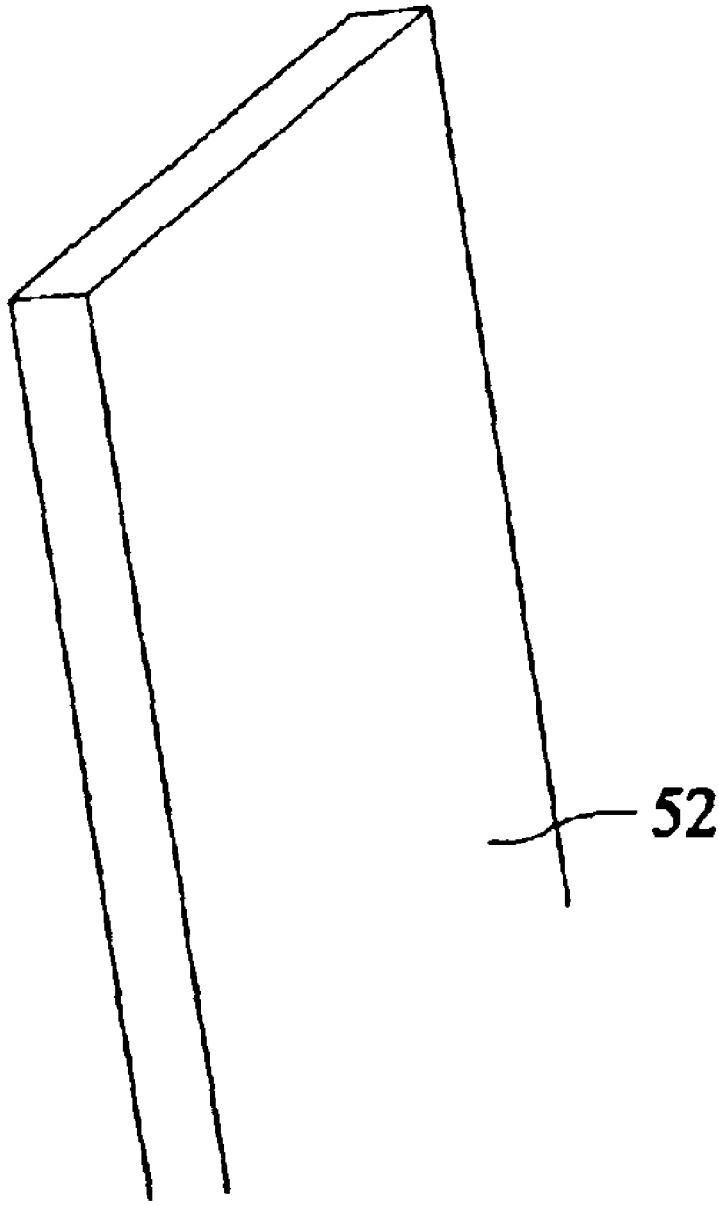
FIG. 22 is a perspective view of a portion of the burner body shown in FIG. 19.
Figure 23:
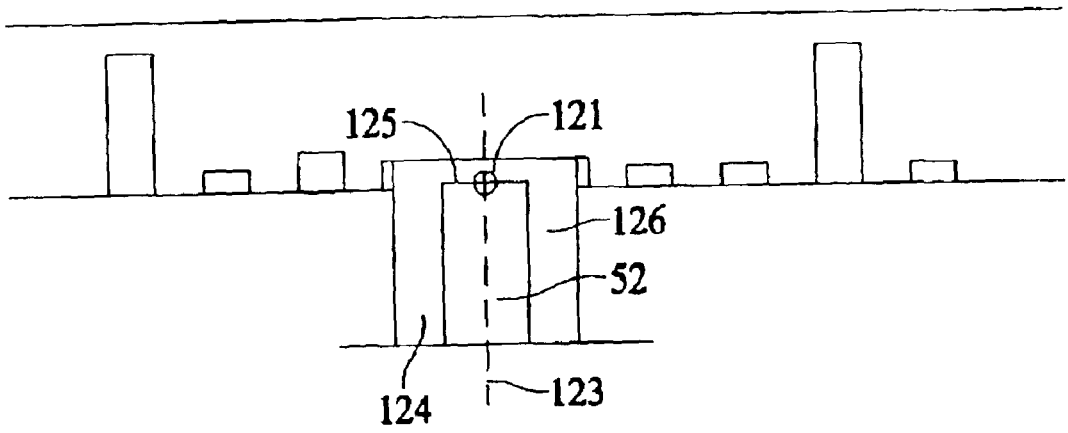
FIG. 23 is a side view of a portion of the burner body shown in FIG. 19.

FIG. 19 is top view of a burner body 120 that can be used with burner assembly 30 (shown in FIG. 2). FIG. 20 is a top view of another embodiment of burner body 120 that can be used with burner assembly 30. FIG. 21 is a top view of a portion of burner body 120 shown in FIG. 19. FIG. 22 is a perspective view of a portion of burner body 120 shown in FIG. 19. FIG. 23 is a side view of a portion of burner body 120 shown in FIG. 19 including an ignition port 121 configured to output gas which is then ignited by igniter 52. In an exemplary embodiment, burner body 120 includes an ignition chamber 122 defined within burner body 120. In the exemplary embodiment, ignition chamber 122 includes an opening 124 extending through burner body 120 such that igniter 52 is input through opening 124 to thereby ignite a gas. In one embodiment, opening 124 is a hole extending through burner body 120. In another embodiment, opening 124 is a slot extending through burner body 120. In the exemplary embodiment, ignition chamber 122 defines a substantially square recess 126 in burner body 120 and igniter 52 is positioned substantially within recess 126. In another exemplary embodiment, ignition chamber 122 defines a substantially rectangular recess 126 in burner body 120 and igniter 52 is positioned substantially within recess 126. Referring to FIG. 23, and in the exemplary embodiment, ignition port 121 is positioned substantially along a central axis 123 of igniter 52, such that a top portion 125 of igniter 52 is positioned proximate to or slightly below ignition port 121.

In use, igniter 52 is positioned within recess 126 such that no pressure is exerted on igniter 52 when an object is diverted towards igniter 52, the object impacts burner body 120, thereby substantially protecting igniter 52 from damage that can occur when igniter 52 is inadvertently struck by an operator.

Figure 24:
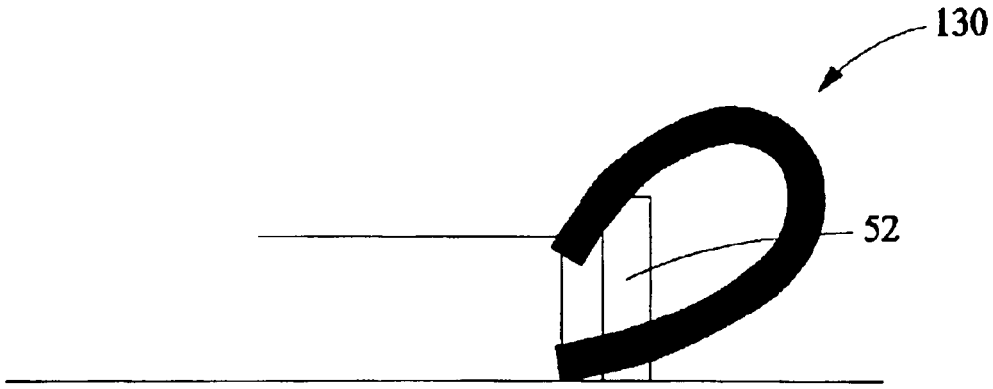
FIG. 24 is a side view of a lobed igniter protection apparatus that can be used with the burner assembly shown in FIG. 2.
Figure 25:
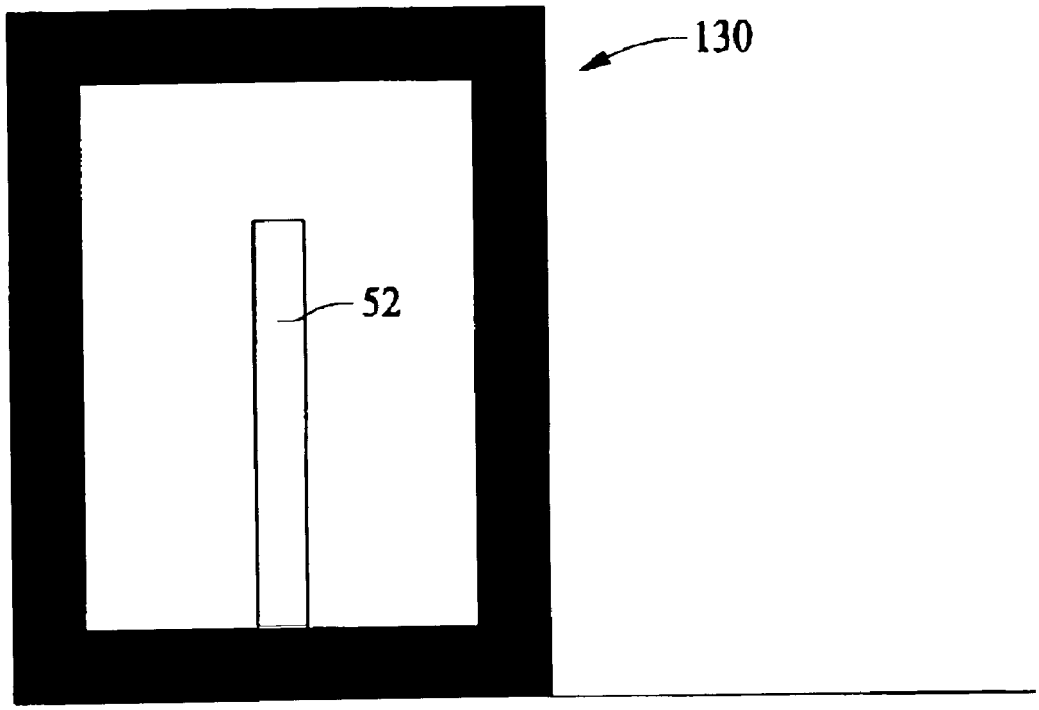
FIG. 25 is a side view of a framed igniter protection apparatus that can be used with the burner assembly shown in FIG. 2.

FIG. 24 is a side view of an igniter protection apparatus 130 that can be used with burner assembly 30 (shown in FIG. 2). FIG. 25 is another embodiment of igniter protection apparatus 130 shown in FIG. 24. In an exemplary embodiment, apparatus 130 is substantially rigid and is positioned such that igniter 52 is at least partially circumscribed. In one embodiment, apparatus 130 is unitary and is formed into a substantially c-shaped structure attached to the burner body 32. In another embodiment, apparatus 130 is substantially rectangular and attached to burner body 32. Apparatus 130 is fabricated from a material such as, but not limited to aluminum, stainless steel, high temperature steels, and brass. In use, apparatus 130 is positioned around igniter 52 such that such that no pressure is exerted on igniter 52, thereby substantially protecting igniter 52 from damage that can occur when the igniter is inadvertently struck by an operator.

Figure 26:
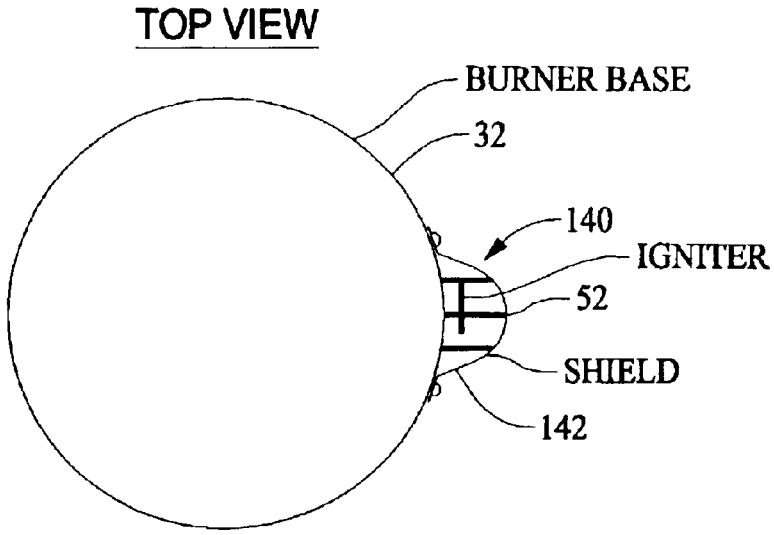
FIG. 26 is a top view of an igniter protection apparatus that can be used with the burner assembly shown in FIG. 2.
Figure 27:
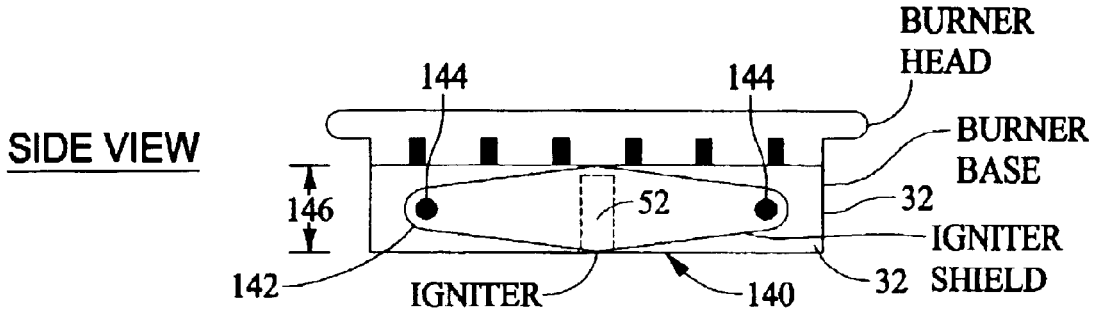
FIG. 27 is a side view of the igniter protection apparatus shown in FIG. 26.

FIG. 26 is a top view of an igniter protection apparatus 140 that can be used with burner assembly 30 (shown in FIG. 2). FIG. 27 is a side view of igniter protection apparatus 140 shown in FIG. 26. In an exemplary embodiment, apparatus 140 includes a guard 142 and at least two mechanical fasteners 144 to mechanically couple guard 142 to burner body 32. Apparatus 140 is positioned adjacent to igniter 52 and at least partially circumscribes igniter 52. Guard 142 includes a first height 146 which is greater than a height of igniter 52. Guard 142 is fabricated from a material such as, but not limited to aluminum, stainless steel, high temperature steels, and brass.

In use, apparatus 140 is positioned adjacent to igniter 52 such that when pressure is exerted on igniter 52, igniter 52 deflects but does not break, thereby substantially protecting igniter 52 from damage that can occur when the igniter is inadvertently struck by an operator. Additionally, apparatus 140 facilitates protecting igniter 52 when an object is inadvertently dropped toward igniter 52, since guard 142 facilitates deflecting the object away from igniter 52 thereby substantially decreasing any inadvertent damage to igniter 52.

Figure 28:
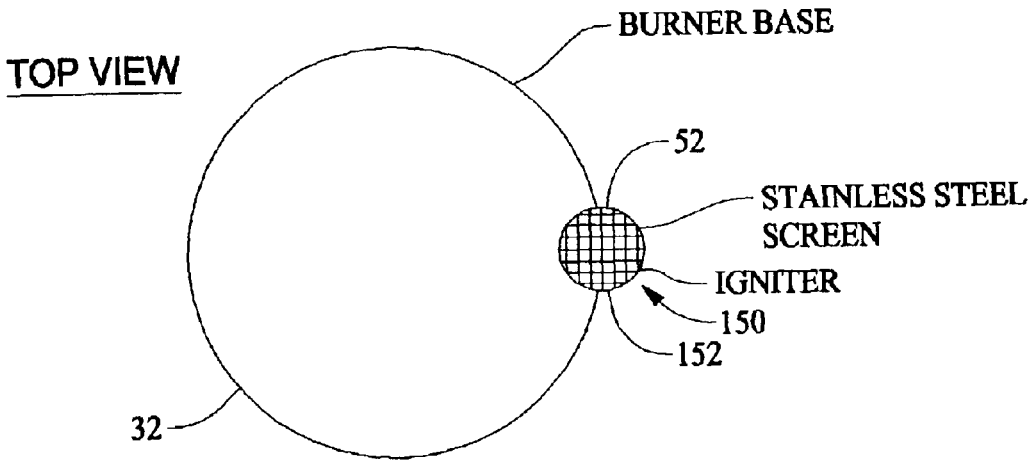
FIG. 28 is a top view of an igniter protection apparatus that can be used with the burner assembly shown in FIG. 2.
Figure 29:
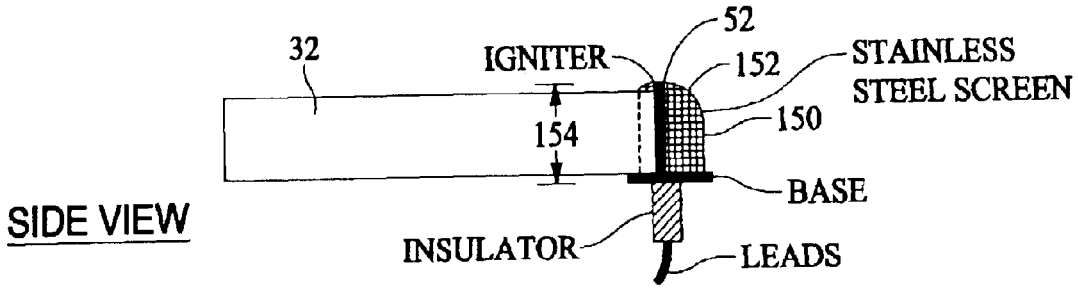
FIG. 29 is a side view of the igniter protection apparatus shown in FIG. 28.

FIG. 28 is a top view of an igniter protection apparatus 150 that can be used with burner assembly 30 (shown in FIG. 2). FIG. 29 is a side view of igniter protection apparatus 150 shown in FIG. 28. In an exemplary embodiment, apparatus 150 includes a protective screen 152 mechanically fastened to at least one of burner body 32 and igniter 52. Apparatus 150 is positioned adjacent to igniter 52 and at least partially circumscribes igniter 52. In one embodiment, protective screen 152 is fabricated from a metallic material, such as, but not limited to, a stainless steel. Protective screen 152 includes a first height 154 which is greater than a height of igniter 52.

In use, apparatus 150 is positioned adjacent to igniter 52 such that no pressure is exerted on igniter 52 thereby substantially protecting igniter 52 from damage that can occur when the igniter is inadvertently struck by an operator. Additionally, apparatus 150 facilitates protecting igniter 52 when an object is inadvertently dropped onto igniter 52, since apparatus 150 facilitates deflecting the object away from igniter 52 thereby substantially decreasing any inadvertent damage to igniter 52.

Although a plurality of ceramic igniter protection apparatuses are described herein, the principles and teaching set forth herein may be used individually to facilitate protecting the ceramic igniter, or may be used in various combinations to facilitate protecting the ceramic igniter.

While the invention has been described in terms of various specific embodiments, those skilled in the art will recognize that the invention can be practiced with modification within the spirit and scope of the claims.

What is claimed is:

1. A gas burner assembly for connection to a source of gas, said gas burner assembly comprising:

a burner body defining an opening therethrough, said opening comprising a recess in an outer perimeter of said burner body;

a burner cap disposed over the said burner body;

a ceramic igniter positioned at least partially within said recess in said burner body; and a ceramic igniter protection apparatus positioned adjacent to said ceramic igniter, said ceramic igniter protection apparatus configured to shield said ceramic igniter from inadvertent contact.

2. A burner assembly in accordance with claim 1 wherein said ceramic igniter protection apparatus comprises:

a first fin having a first height extending from said burner body; and a second fin having a first height extending from said burner body, said igniter positioned between said first fin and said second fin, said igniter having a second height less than said first height, said first fin and said second fin positioned between adjacent burner ports.

3. A burner assembly in accordance with claim 1 wherein said ceramic igniter protection apparatus comprises:

a tab coupled to said burner body;

a first post having a first height extending from said tab; and a second post having the first height extending from said tab, said second post approximately parallel to said first post, said igniter positioned between said first post and said second post, said igniter having a second height less than said first height.

4. A burner assembly in accordance with claim 3 further comprising a connector section extending from a first end of said first post to a first end of said second post.

5. A burner assembly in accordance with claim 1 wherein said ceramic igniter protection apparatus comprises:

a first guard portion having a first height coupled to said burner body; and a second guard portion having a second height different than said first height, said second guard portion coupled to said first guard portion; said first guard portion and said second guard portion configured to at least partially circumscribe said ceramic igniter, said igniter having a height greater than said first height and said second height.

6. A burner assembly in accordance with claim 1 wherein said ceramic igniter protection apparatus comprises:

a first guard portion having a first height coupled to said burner body; and a second guard portion having a second height different than said first height, said second guard portion coupled to said first guard portion; said first guard portion and said second guard portion configured to at least partially circumscribe said ceramic igniter; and at least two tabs mechanically coupled to said second guard portion, said tabs, said combined height of said first guard portion and said second guard portion and said tabs greater than a height of said igniter.

7. A burner assembly in accordance with claim 1 wherein said ceramic igniter protection apparatus comprises a flexible device positioned around said ceramic igniter and beneath said cooktop, said flexible device configured to circumscribe said ceramic igniter.

8. A burner assembly in accordance with claim 1 wherein said burner body comprises an ignition chamber defined within said burner body, said ignition chamber comprising an opening trough said burner body, said ceramic igniter positioned at least partially within said opening.

9. A burner assembly in accordance with claim 1 wherein said ceramic igniter protection apparatus comprises a unitary substantially c-shaped structure at least partially circumscribing said ceramic igniter.

10. A burner assembly in accordance with claim 1 wherein said ceramic igniter protection apparatus comprises:

a guard apparatus; and at least two mechanical fasteners configured to couple said guard apparatus to said burner body, said guard apparatus positioned adjacent to said burner body and configured to at least partially circumscribe said ceramic igniter, said guard apparatus having a first height greater than a height of said ceramic igniter.

11. A burner assembly in accordance with claim 1 wherein said ceramic igniter protection apparatus comprises a protective screen mechanically fastened to at least one of said burner body and said ceramic igniter, said protective screen configured to at least partially circumscribe said ceramic igniter, said protective screen having a first height greater than a height of said ceramic igniter.

12. A gas range, said gas range comprising:

a cooktop; and a gas burner assembly for connection to a source of gas positioned in said cooktop, said gas burner assembly comprising:

a burner body defining an opening therethrough said opening comprising a recess in an outer perimeter of said burner body;

a burner cap disposed over said burner body;

a ceramic igniter positioned at least partially within said recess in said burner body; and a ceramic igniter protection apparatus positioned adjacent to said ceramic igniter, said ceramic igniter protection apparatus configured to shield said ceramic igniter from inadvertent contact.

13. A gas range in accordance with claim 12 wherein said ceramic igniter protection apparatus comprises:

a first fin having a first height extending from said burner body; and a second fin having a first height extending from said burner body, said igniter positioned between said first fin and said second fin, said igniter having a second height less than said first height.

14. A gas range in accordance with claim 12 wherein said ceramic igniter protection apparatus comprises:

a tab coupled to said burner body;

a first post having a first height extending from said tab; and a second post having a first height extending from said tab, said second post approximately parallel to said first post, said igniter positioned between said first post and said second post, said igniter having a second height less than said first height.

15. A gas range in accordance with claim 12 wherein said ceramic igniter protection apparatus comprises:

a first guard portion having a first height coupled to said burner body; and a second guard portion having a second height different than said first height, said second guard portion coupled to said first guard portion; said first guard portion and said second guard portion configured to at least partially circumscribe said ceramic igniter, said igniter having a height greater than said first height and said second height.

16. A gas range in accordance with claim 12 wherein said ceramic igniter protection apparatus comprises:

a first guard portion having a first height coupled to said burner body; and a second guard portion having a second height different than said first height, said second guard portion coupled to said first guard portion; said first guard portion and said second guard portion configured to at least partially circumscribe said ceramic igniter; and at least two tabs mechanically coupled to said second guard portion, said tabs, said combined height of said first guard portion and said second guard portion and said tabs greater than a height of said igniter.

17. A method for protecting a ceramic igniter, said method comprising:

providing a gas burner assembly for connection to a source of gas, said gas burner assembly comprising:

a cooktop;

a burner body positioned in the cooktop, the burner body defining an opening therethrough, the opening comprising a recess in an outer perimeter of the burner body;

a burner cap disposed over the burner body; and a ceramic igniter positioned within the recess in the burner body; and positioning a ceramic igniter protection apparatus adjacent to the ceramic igniter such that the ceramic igniter protection apparatus is configured to shield the ceramic igniter from inadvertent contact.

18. A method for protecting a ceramic igniter in accordance with claim 17 wherein said positioning a ceramic igniter protection apparatus adjacent to the ceramic igniter further comprises positioning a ceramic protection apparatus including a flexible device positioned around the ceramic igniter and beneath the cooktop, the flexible device configured to circumscribe the ceramic igniter.

19. A method for protecting a ceramic igniter in accordance with claim 17 wherein said providing a gas burner assembly including a burner body further comprises providing a burner body including an ignition chamber defined within the burner body, the ignition chamber including an opening through the burner body, the ceramic igniter positioned at least partially within the opening.

20. A method for protecting a ceramic igniter in accordance with claim 17 wherein said positioning a ceramic igniter protection apparatus adjacent to the ceramic igniter further comprises positioning a ceramic protection apparatus including a unitary substantially c-shaped structure at least partially circumscribing the ceramic igniter.

21. A method for protecting a ceramic igniter in accordance with claim 17 wherein said positioning a ceramic igniter protection apparatus adjacent to the ceramic igniter further comprises positioning a ceramic protection apparatus including:

a guard apparatus; and at least two mechanical fasteners configured to couple the guard apparatus to the burner body, the guard apparatus positioned adjacent to the burner body and configured to at least partially circumscribe the ceramic igniter, the guard apparatus having a first height greater than a height of the ceramic igniter.

22. A burner assembly in accordance with claim 8 wherein said ceramic igniter protection apparatus comprises a flexible device positioned around said ceramic igniter and beneath said cooktop, said flexible device configured to circumscribe said ceramic igniter.

23. A method for protecting a ceramic igniter in accordance with claim 19 wherein said positioning a ceramic igniter protection apparatus adjacent to the ceramic igniter further comprises positioning a ceramic protection apparatus including a flexible device positioned around the ceramic igniter and beneath the cooktop, the flexible device configured to circumscribe the ceramic igniter.

* * * * *

UNITED STATES PATENT AND TRADEMARK OFFICE

CERTIFICATE OF CORRECTION

PATENT NO. : 6,935,328 B2
APPLICATION NO. : 10/460888
DATED : August 30, 2005
INVENTOR(S) : Haynes et al.

It is certified that error appears in the above-identified patent and that said Letters Patent is hereby corrected as shown below:

In Claim 1, column 8, line 7, delete "over the said" and insert therefor -- over said --.

In Claim 8, column 9, line 2, delete "an opening trough" and insert therefor -- said opening through --.

In Claim 12, column 9, line 29, between "therethrough" and "said" insert -- , --.

In Claim 17, column 10, line 26, between "positioned" and "within" insert -- at least partially --.

In Claim 19, column 10, beginning on line 43, delete "including an opening" and insert therefor -- including the opening --.

Signed and Sealed this

Sixth Day of November, 2007

JON W. DUDAS
*Director of the United States Patent and Trademark Office*